US011527138B2

(12) United States Patent
Weakley et al.

(10) Patent No.: US 11,527,138 B2
(45) Date of Patent: Dec. 13, 2022

(54) DUAL HARD TAG

(71) Applicant: CHECKPOINT SYSTEMS, INC., Thorofare, NJ (US)

(72) Inventors: Thomas C. Weakley, Simpsonville, SC (US); Morui Li, Cherry Hill, NJ (US)

(73) Assignee: CHECKPOINT SYSTEMS, INC., Thorofare, NJ (US)

( * ) Notice: Subject to any disclaimer, the term of this patent is extended or adjusted under 35 U.S.C. 154(b) by 0 days.

(21) Appl. No.: 17/055,346

(22) PCT Filed: Oct. 11, 2018

(86) PCT No.: PCT/US2018/055339
§ 371 (c)(1),
(2) Date: Nov. 13, 2020

(87) PCT Pub. No.: WO2019/221772
PCT Pub. Date: Nov. 21, 2019

(65) Prior Publication Data

US 2021/0225143 A1 Jul. 22, 2021

Related U.S. Application Data

(60) Provisional application No. 62/672,814, filed on May 17, 2018.

(51) Int. Cl.
*G08B 13/24* (2006.01)
*H01Q 1/22* (2006.01)

(52) U.S. Cl.
CPC ..... *G08B 13/2431* (2013.01); *G08B 13/2417* (2013.01); *G08B 13/2434* (2013.01); *G08B 13/2462* (2013.01); *G08B 13/2474* (2013.01); *H01Q 1/2208* (2013.01)

(58) Field of Classification Search
CPC ..... H01Q 1/2225; G08B 13/2448; G08B 13/2431; G06K 19/0723; G06K 19/07767
See application file for complete search history.

(56) References Cited

U.S. PATENT DOCUMENTS

| | | | |
|---|---|---|---|
| 3,696,379 | A | 10/1972 | Minasy |
| 3,720,940 | A | 3/1973 | Fox et al. |
| 4,206,453 | A | 6/1980 | Williamson |
| 4,481,428 | A | 11/1984 | Charlot, Jr. |

(Continued)

FOREIGN PATENT DOCUMENTS

| | | |
|---|---|---|
| CN | 201122327 Y | 9/2008 |
| EP | 0598624 | 9/1998 |

(Continued)

OTHER PUBLICATIONS

International Search Report for related PCT Application No. PCT/US2018/055339 dated Feb. 4, 2019.

*Primary Examiner* — Mirza F Alam
(74) *Attorney, Agent, or Firm* — McDonald Hopkins LLC

(57) ABSTRACT

A dual hard tag assembly comprises radio frequency identification and electronic article surveillance. The dual hard tag is provides a single component able to both track retail merchandise generally and prevent theft by triggering an alarm. The RFID and EAS systems are not coplanar. The dual hard tag system is small and light weight, and may be reprogrammed and reused for the tracking and anti-theft of multiple items.

20 Claims, 17 Drawing Sheets

(56) References Cited

U.S. PATENT DOCUMENTS

| | | | |
|---|---|---|---|
| 4,502,305 | A | 3/1985 | Bakker |
| 4,546,345 | A | 10/1985 | Naito |
| 4,687,185 | A | 5/1987 | Nourse et al. |
| 4,940,968 | A | 7/1990 | De Nood |
| 5,019,801 | A | 5/1991 | Anderson, III |
| 5,070,581 | A | 12/1991 | Senter |
| 5,081,446 | A | 1/1992 | Gill et al. |
| 5,184,111 | A | 2/1993 | Pichl |
| 5,204,681 | A | 4/1993 | Greene |
| 5,371,490 | A | 12/1994 | Martinides |
| 5,381,137 | A | 1/1995 | Graem et al. |
| 5,444,223 | A | 8/1995 | Blama |
| 5,446,447 | A | 8/1995 | Carney et al. |
| 5,508,684 | A | 4/1996 | Becker |
| 5,510,769 | A | 4/1996 | Kafjez et al. |
| 5,515,580 | A | 5/1996 | McHenry, Jr. |
| 5,519,381 | A | 5/1996 | Marsh et al. |
| 5,524,463 | A | 6/1996 | Schenkel et al. |
| 5,581,257 | A | 12/1996 | Greene et al. |
| 5,583,489 | A | 12/1996 | Loemker et al. |
| 5,604,486 | A | 2/1997 | Lauro et al. |
| 5,615,454 | A | 4/1997 | Contarino |
| 5,627,520 | A | 5/1997 | Grubbs et al. |
| 5,689,237 | A | 11/1997 | Sasagawa et al. |
| 5,699,591 | A | 12/1997 | Kane |
| 5,726,628 | A | 3/1998 | Yoo |
| 5,793,200 | A | 8/1998 | Berrill |
| 5,821,859 | A | 10/1998 | Schrott et al. |
| 5,939,984 | A | 8/1999 | Brady et al. |
| 5,955,951 | A | 9/1999 | Wischerop et al. |
| 5,969,613 | A | 10/1999 | Yeager et al. |
| 5,973,600 | A | 10/1999 | Mosher, Jr. |
| 6,011,474 | A | 1/2000 | Coffey et al. |
| 6,025,780 | A | 2/2000 | Bowers et al. |
| 6,052,876 | A | 4/2000 | Hogan et al. |
| 6,072,383 | A | 6/2000 | Gallagher, II et al. |
| 6,104,311 | A | 8/2000 | Lastinger |
| 6,107,910 | A | 8/2000 | Nysen |
| 6,121,878 | A | 9/2000 | Brady et al. |
| 6,154,137 | A | 11/2000 | Goff et al. |
| 6,154,139 | A | 11/2000 | Heller |
| 6,169,483 | B1 | 1/2001 | Ghaffari et al. |
| 6,188,320 | B1 | 2/2001 | Kolton et al. |
| 6,259,991 | B1 | 7/2001 | Nysen |
| 6,304,169 | B1 | 10/2001 | Blama et al. |
| 6,356,197 | B1 | 3/2002 | Patterson et al. |
| 6,359,444 | B1 | 3/2002 | Grimes |
| 6,362,738 | B1 | 3/2002 | Vega |
| 6,380,855 | B1 | 4/2002 | Ott |
| 6,498,923 | B2 | 12/2002 | Ikefujl et al. |
| 6,509,828 | B2 | 1/2003 | Bolavage et al. |
| 6,518,887 | B2 | 2/2003 | Suzuki et al. |
| 6,580,358 | B1 | 6/2003 | Nysen |
| 6,617,962 | B1 | 9/2003 | Horwitz et al. |
| 6,624,753 | B2 | 9/2003 | Elston |
| 6,646,554 | B1 | 11/2003 | Goff et al. |
| 6,696,953 | B2 | 2/2004 | Qiu et al. |
| 6,714,120 | B2 | 3/2004 | Blama et al. |
| 6,727,817 | B2 | 4/2004 | Maloney |
| 6,780,265 | B2 | 8/2004 | Bleckmann et al. |
| 6,891,466 | B2 | 5/2005 | Turner et al. |
| 6,894,614 | B2 | 5/2005 | Eckstein et al. |
| 7,129,841 | B2 | 10/2006 | Feibelman |
| 7,183,914 | B2 | 2/2007 | Norman et al. |
| 7,183,917 | B2 | 2/2007 | Piccoli et al. |
| 7,227,467 | B2 | 6/2007 | Feibelman |
| 7,239,244 | B2 | 7/2007 | Leyden et al. |
| 7,249,401 | B2 | 7/2007 | Copen et al. |
| 7,315,253 | B1 | 1/2008 | Pijanowski |
| 7,456,741 | B2 | 11/2008 | Norman et al. |
| 7,724,146 | B2 | 5/2010 | Nguyen et al. |
| 7,808,390 | B2 | 10/2010 | Sayegh |
| 7,986,241 | B2 | 7/2011 | Copeland |
| 8,004,406 | B2 | 8/2011 | Bleckmann et al. |
| 8,035,518 | B2 | 10/2011 | Kolton et al. |
| 8,089,362 | B2 | 1/2012 | Chamandy et al. |
| 8,269,632 | B2 | 9/2012 | Hesch et al. |
| 8,344,891 | B2 | 1/2013 | Appalucci et al. |
| 8,547,228 | B2 | 10/2013 | Brodzik et al. |
| 8,547,229 | B2 | 10/2013 | Brodzik et al. |
| 8,581,726 | B2 | 11/2013 | Piccoli et al. |
| 9,324,015 | B2 | 4/2016 | Wu et al. |
| 2003/0020613 | A1 | 1/2003 | Cosnard |
| 2003/0227385 | A1 | 12/2003 | Lancaster |
| 2008/0068177 | A1* | 3/2008 | Copeland ..... G08B 13/2437 340/572.7 |
| 2009/0189768 | A1* | 7/2009 | Copeland ..... H01Q 9/285 340/572.7 |
| 2009/0224918 | A1* | 9/2009 | Copeland ..... G06Q 20/3278 340/572.1 |
| 2010/0001079 | A1* | 1/2010 | Martin ..... G06K 19/07749 235/492 |
| 2010/0308998 | A1* | 12/2010 | Hesch, Jr. ..... E05B 73/0017 340/572.8 |
| 2014/0240088 | A1* | 8/2014 | Robinette ..... G08B 13/1427 340/5.61 |

FOREIGN PATENT DOCUMENTS

| | | |
|---|---|---|
| EP | 1548640 | 6/2005 |
| EP | 1171300 | 9/2005 |
| EP | 2417317 | 2/2012 |
| EP | 3001357 | 3/2016 |
| GB | 2187706 | 9/1987 |
| GB | 2305212 | 4/1997 |
| JP | 2002074530 | 3/2002 |
| KR | 20030079036 | 10/2003 |
| KR | 20050020918 | 3/2005 |
| WO | 98/40591 | 9/1998 |
| WO | 2006127674 | 11/2006 |
| WO | 2008068725 | 6/2008 |

* cited by examiner

DUAL HARD TAG

CROSS-REFERENCE TO RELATED APPLICATION

This application is a 35 U.S.C. 371 national stage filing and claims priority to International Application No. PCT/US2018/55339 entitled "DUAL HARD TAG," filed on Oct. 11, 2018 which claims the benefit of U.S. Provisional Patent Application No. 62/672,814, entitled "DUAL HARD TAG," filed on May 17, 2018, each of which is hereby incorporated by reference.

TECHNICAL FIELD

The present disclosure relates to electronic article surveillance (EAS) systems, radio frequency identification (RFID) systems and, more particularly, to removable, reusable hard tags for use in inventory tracking and anti-theft applications.

BACKGROUND

RFID tags are commonly used in a number of settings, including in retail loss prevention. In this regard, retail theft prevention systems, often referred to as EAS systems, use antennae located at the exits of a retail establishment to detect RFID hard tags that are affixed to sale items. An RFID hard tag may be affixed to a sale item, and if the label is not deactivated at a point-of-sale during a sales transaction, an EAS system will detect the RFID hard tag when the RFID hard tag is within range of the EAS system. The EAS system is often disposed near the exit of a store so that the range monitors for RFID hard tags leaving the store.

For instance, the EAS system uses a transmitter to emit a signal at a predetermined RFID frequency. The RFID hard tag is tuned to the predetermined frequency so that it responds to the signal, and a receiver detects the RFID hard tag response. This response can then be used for determining whether to set off an alarm or not. An alarm may be triggered because the removal of an active RFID hard tag from the retail establishment is likely to be associated with an attempted theft.

Traditionally, apparel items are tagged with a hard tag device. This hard tag device has a hard outer shell and internal circuitry that may comprise either EAS or RFID elements. These security devices are wirelessly detected at retail store exits or points of sale to prevent inappropriate removal of the item. These hard tags utilize a metallic pin and lock mechanism to secure the tag to an article (e.g., clothing) for protecting the article against theft. The hard tags must be removed by a store employee at the register so that the customer may review the item.

Thus, there remains a need for a hard tag that includes both an EAS device and an RFID device. Moreover there is a need for a more efficient hard tag with respect to size and accuracy.

SUMMARY

The following presents a summary of this disclosure to provide a basic understanding of some aspects. This summary is intended to neither identify key or critical elements nor define any limitations of embodiments or claims. Furthermore, this summary may provide a simplified overview of some aspects that may be described in greater detail in other portions of this disclosure.

Disclosed herein is a security tag comprising a housing, an inventory tracking circuit disposed within the housing, the inventory tracking circuit comprising an antenna and a memory operatively storing inventory parameters, and a security circuit comprising a wireless device that operatively monitors for a wireless signal in a given frequency, and responds to the wireless signal when detected to initiate an alert associated with improper removal of the item, wherein the inventory tracking circuit does not overlap with the security circuit. The housing may comprise a hard plastic material. The inventory tracking circuit may comprise a radio frequency identification label. The security circuit may comprise an electronic article surveillance device. The inventory tracking circuit may be generally orthogonal with the security tracking circuit. The inventory tracking circuit may be non-coplanar with the security tracking circuit. The inventory tracking circuit may be non-overlapping with the security tracking circuit with respect to a plane defined by a bottom surface of the housing. The security tracking circuit may comprise an electronic article surveillance inlay. The security tracking circuit may comprise a loop antenna.

In another aspect, a security tag may comprise a housing comprising an internal cavity, a radio frequency identification label disposed within the internal cavity, an electronic article surveillance circuit disposed within the internal cavity, and a locking mechanism, wherein the radio frequency identification label is non-overlapping with the electronic article surveillance circuit. The electronic article surveillance circuit may comprise a loop antenna. The loop antenna may encompass the locking mechanism. The loop antenna may be free from encompassing the locking mechanism. The housing may comprise a bottom internal surface and wherein the radio frequency identification label is disposed on the bottom internal surface. The housing may comprise an internal formation that operatively retains the radio frequency identification label. The internal formation may comprise a channel.

Also described is a security tag comprising a housing comprising an internal perimeter, an inventory tracking circuit disposed within the housing, the inventory tracking circuit comprising an antenna and a memory operatively storing inventory parameters, a security circuit comprising a wireless device that operatively monitors for a wireless signal in a given frequency, and responds to the wireless signal when detected to initiate an alert associated with improper removal of the item, wherein the inventory tracking circuit comprises a label that operatively abuts at least a portion of the internal perimeter. The label may operatively abut a majority of the internal perimeter. In another aspect, the label may operatively abut generally the entire internal perimeter. The label may be non-coplanar and non-overlapping with the security circuit.

The following description and the drawings disclose various illustrative aspects. Some improvements and novel aspects may be expressly identified, while others may be apparent from the description and drawings.

DESCRIPTION OF THE DRAWINGS

The present teachings may be better understood by reference to the following detailed description taken in connection with the following illustrations, wherein.

Figure 1:
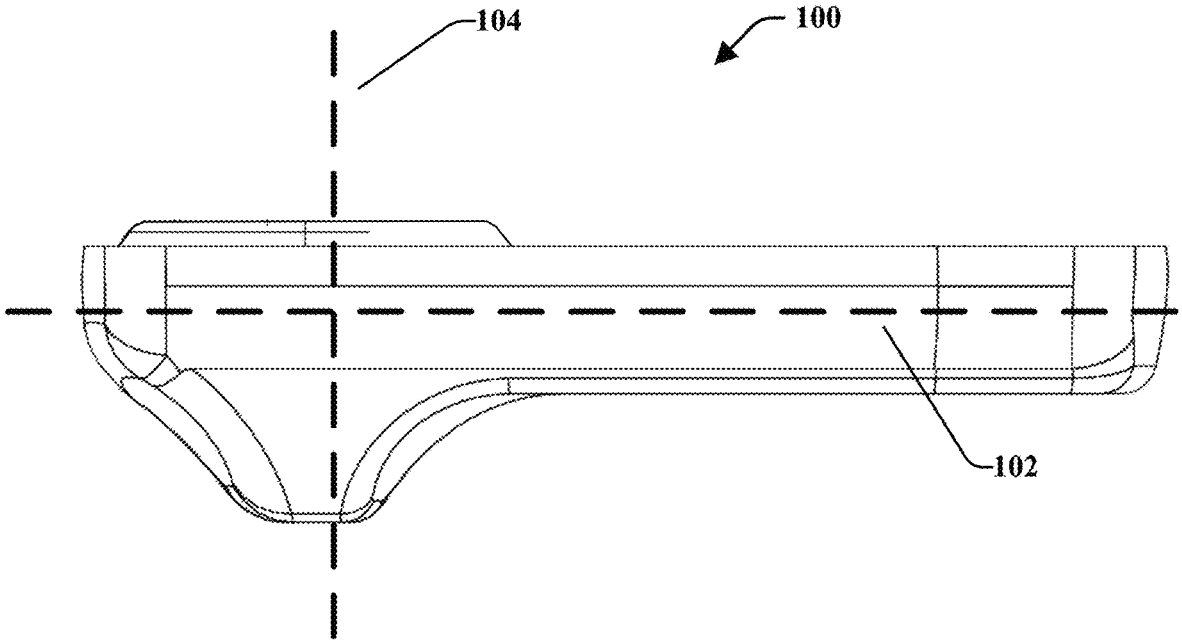
FIG. 1 is a side view of a hard tag comprising an EAS component and RFID components in accordance with various disclosed aspects.

The invention may be embodied in several forms without departing from its spirit or essential characteristics. The scope of the invention is defined in the appended claims, rather than in the specific description preceding them. All embodiments that fall within the meaning and range of equivalency of the claims are therefore intended to be embraced by the claims.

DETAILED DESCRIPTION

Reference will now be made in detail to embodiments of the present teachings, examples of which are illustrated in the accompanying drawings. It is to be understood that other embodiments may be utilized and structural and functional changes may be made without departing from the scope of the present teachings. Moreover, features of the embodiments may be combined, switched, or altered without departing from the scope of the present teachings, e.g., features of each disclosed embodiment may be combined, switched, or replaced with features of the other disclosed embodiments. As such, the following description is presented by way of illustration and does not limit the various alternatives and modifications that may be made to the illustrated embodiments and still be within the spirit and scope of the present teachings.

As used herein, the words "example" and "exemplary" mean an instance, or illustration. The words "example" or "exemplary" do not indicate a key or preferred aspect or embodiment. The word "or" is intended to be inclusive rather an exclusive, unless context suggests otherwise. As an example, the phrase "A employs B or C," includes any inclusive permutation (e.g., A employs B; A employs C; or A employs both B and C). As another matter, the articles "a" and "an" are generally intended to mean "one or more" unless context suggests otherwise.

"Logic" refers to any information and/or data that may be applied to direct the operation of a processor. Logic may be formed from instruction signals stored in a memory (e.g., a non-transitory memory). Software is one example of logic. In another aspect, logic may include hardware, alone or in combination with software. For instance, logic may include digital and/or analog hardware circuits, such as hardware circuits comprising logical gates (e.g., AND, OR, XOR, NAND, NOR, and other logical operations). Furthermore, logic may be programmed and/or include aspects of various devices and is not limited to a single device.

The terms "identification tag," "chip," "RFID device," and the like may be used interchangeably, unless context suggests otherwise or warrants a particular distinction among such terms. It is further noted that RFID tags may be chosen based on a frequency (e.g., low frequency RFID tags for close communication). Identification tags may comprise printable RFID tags, NFC tags, tags including microchips, or the like. Identification tags can contain stored information, such as in a memory (e.g., read-only memory (ROM), random access memory (RAM), electrically erasable programmable read-only memory (EEPROM), or various other types of memory). In another aspect, an identification tag may be powered by electromagnetic induction from magnetic fields produced by a reader. For instance, an identification tag may include an NFC component that uses induction between two loop antennae located within the container's near field, effectively forming an air-core transformer. The antennae may comprise various materials, such as copper. While an air-core transformer is described, various other antennae formations may be utilized.

In an example, an RFID component may include a tag and an emitter. The tag and emitter may each include one or more antennae. For instance, the tag may include a loop antenna and the emitter may include another loop antenna. It is noted that the loop antennae may or may not be substantially similar to each other. The tag antenna and emitter antenna may be operatively coupled via an electromagnetic field. The coupling may form or represent an air-core coil or transformer. The emitter may generate an alternating current that may be received by the emitter antenna. The current may induce an electromagnetic field through the air or another carrier medium. The electromagnetic field may induce a current in the tag antenna. The received current may provide power to various components of the tag.

In various embodiments, a tag may include the antenna (e.g., inlay), a processor, and a memory device. The memory device may include various types of memory, such as electrically erasable programmable read-only memory (EEPROM) and the like. When the tag is powered (e.g., current induced by the electromagnetic field), the tag may generate a response that may be received by the emitter.

As described herein, the identification tag may be a passive transponder that collects energy from interrogating radio waves and/or may include a local power source such as a battery. As such, an identification tag and a reader may be configured as a passive reader active tag (PRAT) system, active reader passive tag (ARPT) system, an active reader active tag (ARAT) system, or the like.

In another aspect, an identification tag may power various components or devices. For example, an RFID component may power a digital display and/or interface of a container. In embodiments, the identification tag may be configured to operate and/or communicate with a reader when within a threshold distance. For instance, an identification tag may communicate with a reader when the identification tag is less than or equal to j units from the reader, where j is a number and the unit is a unit of distance. In an example, the identification tag may operate when it is less than or about six centimeters from the reader, when it is less than or about one meter from the reader, etc.

A dual hard tag assembly with RFID anti-theft and EAS tracking is described herein. The dual hard tag may comprise an RFID and EAS combination hard tag. The term "dual hard tag" is utilized to refer to a tag that comprises an EAS device, such as a coil, ferrite, or label, and an RFID component, such as an inlay or label. The resulting hard tag allows for both the tracking of inventory and anti-theft precautions. The hard tag may also comprise a locking mechanism and pin for use with garments or items with other soft or malleable material. The pin trespasses the garment and is inserted in the locking mechanism of the hard tag to fix the garment between the pin and the hard tag itself. The hard tag remains secure to the garment until removed by a proper device. After removal, the hard tag may be reprogrammed and reused for the tracking and anti-theft of other items. As a recirculation or recycling hard tag, this product requires minimum size and weight and thereby reduces the transportation cost on recycling process.

The RFID inlay may comprise a folded dipole antenna that does not include (e.g., are free of) inward spiral antennas or far-field components with inward spirals. Thus, reference to the RFID inlay excludes hybrid type antennas having inward spiral antenna, a magnetic loop antenna and an integrated circuit. Moreover, the described embodiments do not require impedance matching based on properties of an EAS component. For instance, some traditional tags with EAS components and hybrid or other antennas require impedance matching to meet requirements. Aspects of disclosed embodiments do not require impedance matching of the RFID inlay. As such, the RFID inlay can perform to system requirements with or without an EAS component. Traditional hard tags do not have the ability to perform with or without the EAS component and without impedance matching of an antenna.

In one possible use, the hard tag is applied to garments by retailers at the point of manufacture or at a distribution center. After being applied to the garment using a pin and locking mechanism, the garments are re-packaged, typically in cardboard boxes. These boxes are placed on a conveyer and run through a tunnel encoding system. The encoding system programs the memory in the RFID inlay or label with the product's SKU, serial number, and other pertinent information (e.g. color, size, and other identifiable information). The boxes are then shipped from the distribution center to the retail store. Once at the store, the RFID component can be used in conducting inventories on the items in the backstock or retail floor areas. The EAS component and pedestals at the store exits help deter theft. If the hard tag is not removed from the garment and it passes through a store exit, generally the alarms will sound and lights will flash. The hard tag can only be removed using a specific detacher able to unlock the pin from the locking mechanism. In the store, the hard tag is removed at the checkout and, in case of recycling process, all the hard tags are shipped back to the point of manufacture or to the distribution center.

In one embodiment, a large percentage of the hard tag's interior has been used or is occupied by the EAS device. The detection rate on EAS coils is improved when the area increases and the number of turns can be increased. In another embodiment the RFID and EAS systems are positioned on different planes, i.e., they are not coplanar. The assembly of the internal components within the hard tag achieves high RFID and EAS performance with minimum size and weight. The minimum size and weight enables cost-effective reuse and reprogramming of the hard tags for the tracking and anti-theft of multiple items. In some embodiments, the EAS component may circumscribe the internal locking mechanism. In other embodiments, the EAS component may be located apart from the internal locking mechanism. Moreover, the RFID component may be located on the interior perimeter of the hard tag.

Figure 2:
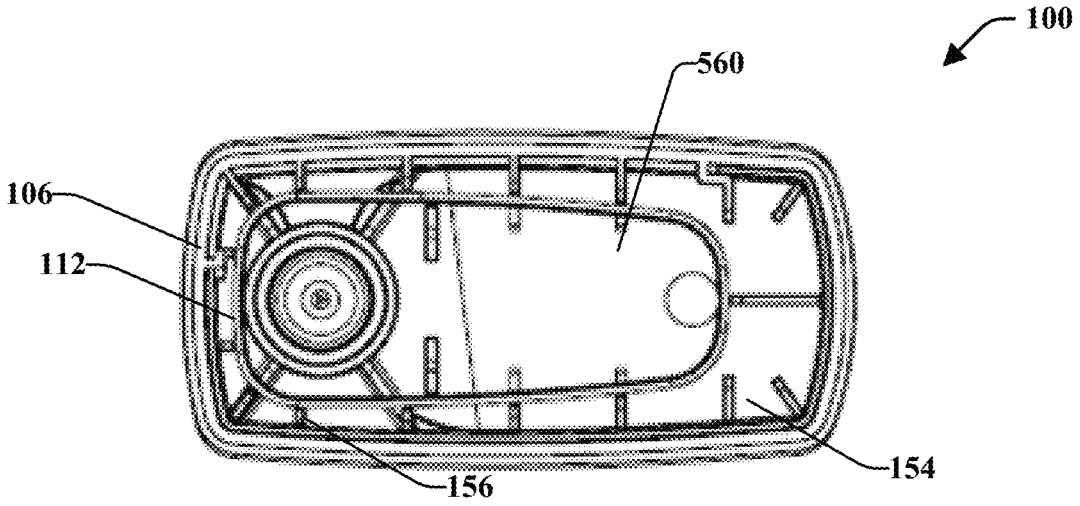
FIG. 2 is a top cross-sectional view of the hard tag of FIG. 1 in accordance with various disclosed aspects.
Figure 3:
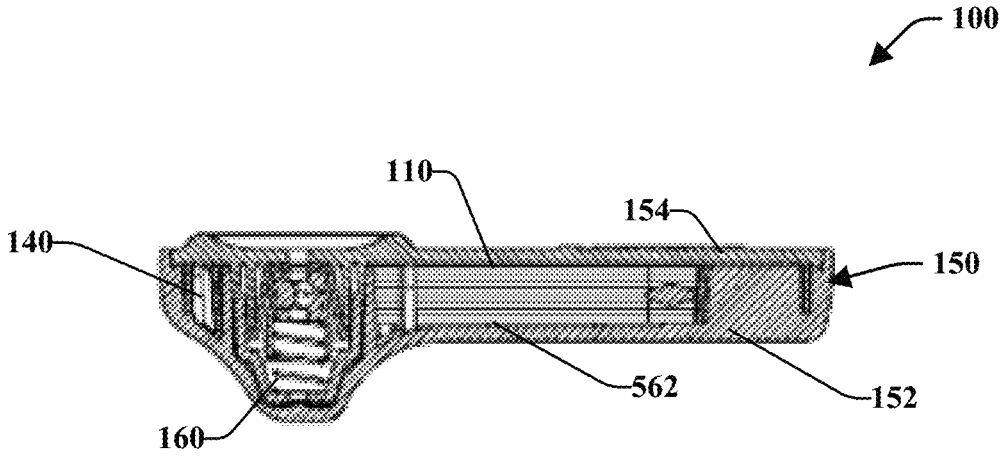
FIG. 3 is a side cross-sectional view of the hard tag of FIG. 1 in accordance with various disclosed aspects.
Figure 4:
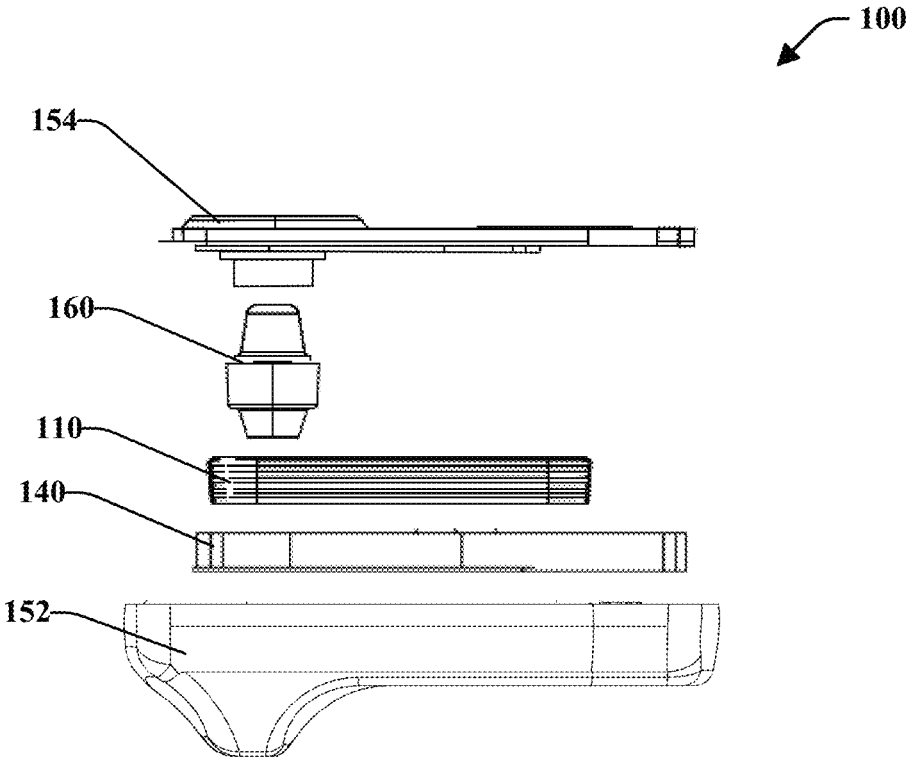
FIG. 4 is a side, exploded perspective view of the hard tag of FIG. 1 in accordance with various disclosed aspects
Figure 5:
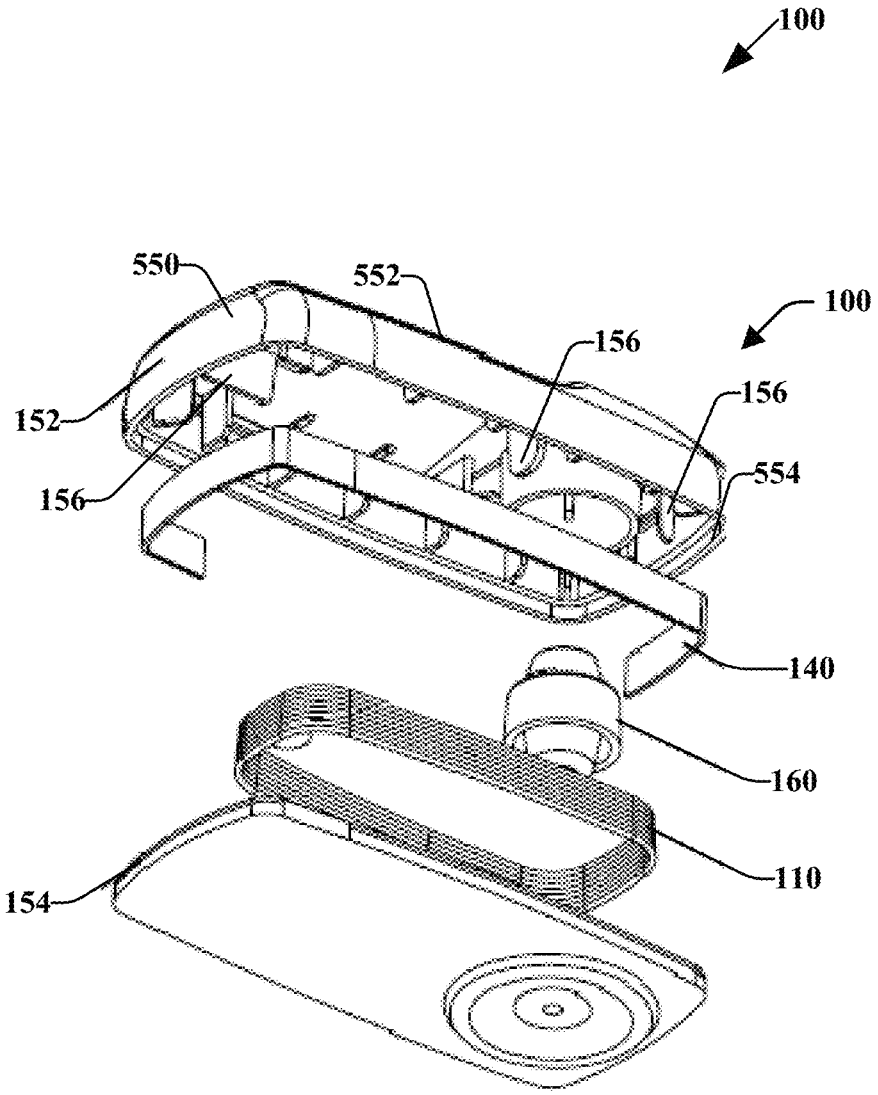
FIG. 5 is a prospective, exploded perspective view of the hard tag of FIG. 1 in accordance with various disclosed aspects.

Turning to FIGS. 1-5, illustrate a dual hard tag assembly 100. A side view is shown in FIG. 1, a cross-sectional view taken across axis 102 is shown in FIG. 2, and a cross-sectional view taken across axis 104 is shown in FIG. 3. FIGS. 4-5 show exploded views of the dual hard tag assembly 100. The deal hard tag assembly 100 may primarily comprise a security circuit or EAS component 110, an inventory tracking circuit 140 (e.g., an RFID label), a cover or housing 150, and a locking mechanism 160. The housing 150 may be monolithically formed or may comprise one or more portions operatively assembled together, such as a top cover 152 and a bottom cover 154. It is noted that the housing 150 may comprise any appropriate shape and material, such as plastic. The locking mechanism 160 may comprise a pin 162 for attachment to a garment or other item, as described herein. It is noted that the locking mechanism 160 may operatively secure the hard tag assembly 100 to a garment or other item. The locking mechanism 160 may be removed from the garment through use of a detaching device. The locking mechanism 160 may include various styles or models. In at least some embodiments, the locking mechanism 160 is a pin locking device, where a pin pierces an article and is held in place. The pin is released through the use of the detaching device The EAS component 110 may comprise an antenna 112. The antenna 112 may comprise a coil antenna that includes a number of turns. In an aspect, the antenna 112 may be coupled with a processor, memory, or other circuitry. For instance, the EAS component 110 may comprise a metal coil (e.g., copper coil, ferrous materials, etc.), an inlay, a printed circuit board, a chop, or the like.

According to at least one embodiment, the antenna 112 may operatively loop around or circumscribe the locking mechanism 160. This may allow the antenna 112 to occupy a substantial footprint, as shown in FIG. 1, of the housing 150. The increased size of the antenna, in contrast to antennae that do not comprise a large footprint, may allow the antenna 112 to comprise more loops or turns. Increased numbers of turns and the increased area occupied by the antenna 112 may allow the detection rate on the EAS coil to increase or improve. It is noted that the antenna 112 may be 47×23 mm. In another aspect, the antenna 112 may occupy or circumscribe generally 60-85%, such as generally 75%, of the footprint when viewed across axis 102.

In an embodiment, the locking mechanism 160 may comprise metallic components (e.g., pins, bearings, etc.), one or more magnets, or the like. The antenna 112 may circumscribe or loop around the locking mechanism 160. The increased size of the antenna 112 may negate interference from the magnetic field of the locking mechanism 160. In other embodiments, as described herein and shown in FIG. 6, an antenna may not loop around the locking mechanism. Embodiments including antennae that do not encompass the locking mechanism 160 may not be disturbed by magnetic fields of the locking mechanism 160, which may allow for increase or improved rates of detection of the EAS component 110.

The inventory tracking circuit 140 may comprise an inlay or label. The label may be non-coplanar with the EAS component 110. For instance, the inventory tracking circuit 140 may be placed orthogonally (e.g., generally 90 degrees, such as between 70 and 120 degrees) to the EAS component 110. The inventory tracking circuit 140 may be disposed such that it occupies a majority of a perimeter 106 of the housing 150. For instance, the inventory tracking circuit 140 may be disposed along the length of a first end 550 of the housing 150, a second end 556, and a first side 554. A second side may be free of the inventory tracking circuit 140. It is noted, that the hosing 150 may comprise various shapes and sizes, such as elliptical, spherical, n-sized prisms (where n is a number), or irregular in shape. As such, the inventory tracking circuit 140 may generally occupy the entire or a majority of the perimeter 106, such greater than 51 percent, about 75 percent, etc. In other embodiments, the inventory tracking circuit 140 may be disposed about generally half (e.g., such as about the first side 554 and first end 556) or less than half of the perimeter 106 (e.g., about the first side 552 or a portion thereof).

The inventory tracking circuit 140 may be positioned and held into place by one or more formations 156 formed in the housing 150. For instance, the housing 150 may comprise ribs, grooves, tracks, hooks, or other formations that may hold the inventory tracking circuit 140 into place. It is noted that some embodiments may utilize fasteners (e.g., bolts, screws, etc.), adhesives that may adhere the inventory tracking circuit 140 or a portion thereof directly to the housing 150, internal walls, or the like. It is further noted that the inventory tracking circuit 140 may be disposed at various other locations within the housing 150. For instance, the inventory tracking circuit 140 may be disposed within a central opening of the EAS component 110 or at various other locations.

In various embodiments, as described herein, the inventory tracking circuit 140 may be disposed so that it does not overlap with the EAS component 110 or is not coplanar with the EAS component 110. As noted, the EAS component 110 and inventory tracking circuit 140 may be generally orthogonal with each other, may be generally coaxial with each other, or may be otherwise arranged such that they are not vertically overlapping with respect to an inner surface 560 of the top cover 154 or an inner surface 562 of the bottom cover 152.

In some embodiments, as described here and elsewhere in this disclosure, the inventory tracking circuit 140 may be adhered to the perimeter 106, the inner surface 560, the inner surface 562, or the like. The EAS component 110 does not vertically overlap with respect to the inner surface 560 or the inner surface 562. It is further noted that the inventory tracking circuit 140 or EAS component 110 may be embedded or overmolded within plastic, may be adhered to a portion of one or more of the perimeter 106, the inner surface 560, or the inner surface 562. In other embodiments, the housing 150 may comprise other shapes and sizes and inventory tracking circuit 140 and EAS component 110 may be arranged within such housings in accordance with various disclosed aspects.

Figure 18:
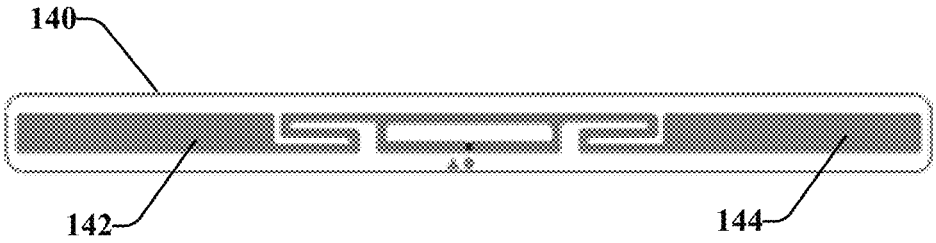
FIG. 18 is a schematic view of the RFID inlay of FIG. 1 in accordance with various disclosed aspects.
Figure 15:
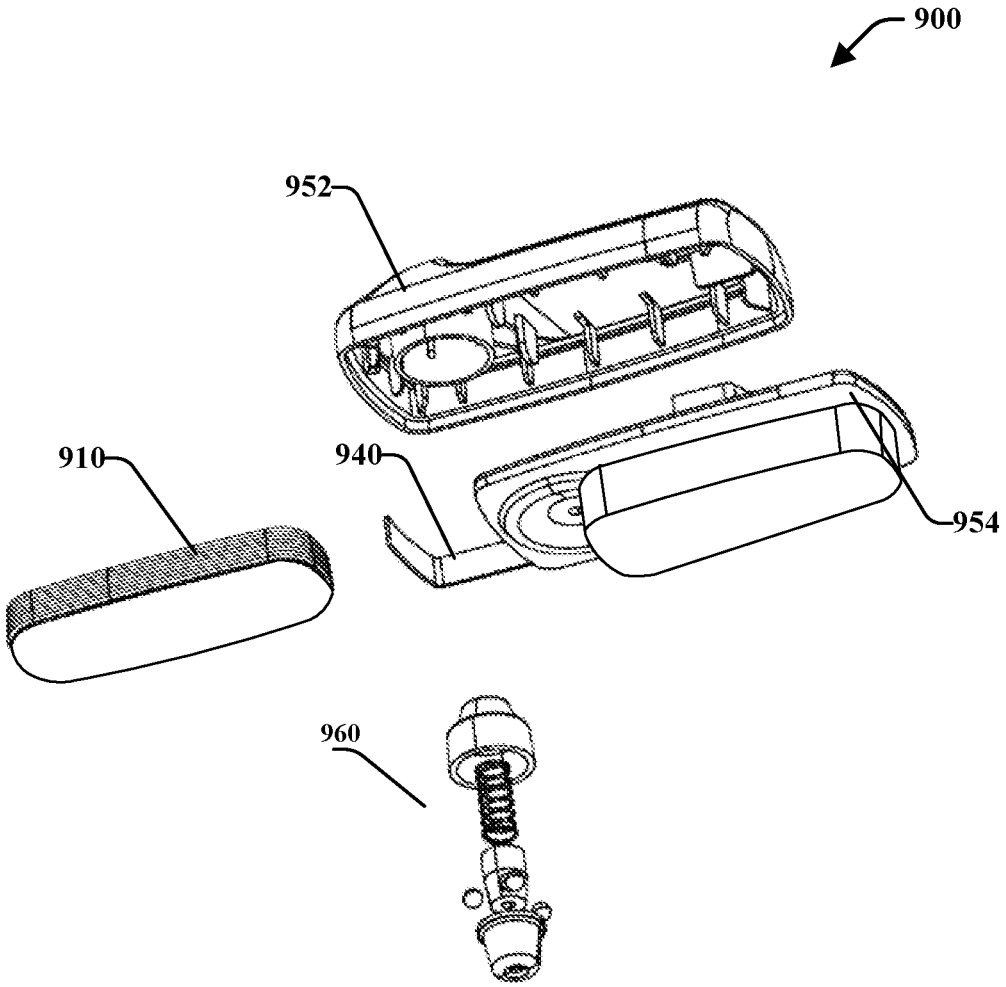

As shown in FIG. 18, the RFID label antennae or inventory tracking circuit 140 may be designed using one variation or another of a dipole antenna having two nulls 142/144, such as a folded dipole antenna. The nulls are positions where the RFID label antenna does not receive energy from an electric field waveform. These nulls are located at either end of the RFID label antenna. In disclosed embodiments, dipoles of the inventory tracking circuit 140 may wrap beyond the location where a dipole would traditionally end. As such, the inventory tracking circuit 140 may reduce the effect of these nulls and the RFID coverage area may be increased.

The inventory tracking circuit 140 may communicate within a designated frequency, such as ultra high frequencies (UHF), low frequency (LF) or high frequency (HF). It is noted that the inventory tracking circuit 140 may comprise a wireless transmitter or receiver circuity comprising circuitry for acousto-magnetic (AM) communication, radio frequency (RF) communication, electro-magnetic (EM), benefit denial type security communication, a dipole UHF antenna, an HF circuit or device, an inductive coil looping, an RFID chip, or the like. As an example, the inventory tracking circuit 140 may include an antenna electrically connected to an RFID chip. The RFID chip may be constructed with silicon. The antenna may include a dipole and loop. In some instances, the dipole and loop may operatively function within a particular frequency and may be positioned in consideration of inductive coupling with other RF circuits, such as an inductor coil/LC circuit.

The inventory tracking circuit 140 operatively receives or collects, such as through an antenna, carrier wave (CW) energy transmitted from an RFID reader. The energy may power the RFID chip. The RFID chip may process commands from the reader, as encoded in the CW. It is further noted that the RFID label may generate a reply in response to the received signals, such as through backscattering from an antenna.

In embodiments, the inventory tracking circuit 140 includes an integrated circuit which may include or be coupled with an RF LC circuit (resonant circuit) or antenna tuned to a predetermined RF frequency. The inventory tracking circuit 140 may include a memory that may be programmable, readable, readable/writable, or the like. The memory may store information associated with an article, such as an article to which the hard tag assembly 100 is to be attached or to which it is attached. (e.g., product ID information such as a serial number, unique identification number, price, etc.). When a transmitter emits a signal at the predetermined RF frequency and threshold value which is received by the tuned antenna, the RFID element emits a signal containing the stored information which is then received by a receiver and the information demodulated from the element-emitted signal. This information can then be used for, among other things, inventory management (e.g., merchandise visibility and inventory control, location monitoring, etc.), security systems, programing of the inventory tracking circuit 140, or the like.

Disclosed embodiments may be particularly well suited for use in a recycling or recirculation process, where the inventory tracking circuit 140 may be reprogrammed after it is removed from an article. For example, the hard tag assembly 100 may be applied to a garment by a retailer. In some processes, a retailer may apply multiple hard tag assemblies 100 to multiple garments at the point of manufacture or at a distribution center. These garments may be packaged, such as packed in cardboard boxes, and placed on a conveyor and run through a tunnel encoding system. The encoding system programs a memory in the RFID labels 140 with the inventory management information or other information. As an example, the memories may be programed with a product's SKU, serial number, and other pertinent information (color, size, etc.). The boxes are then shipped from the distribution center to the retail store. In the store, the hard tag assemblies 100 are removed at the checkout. These hard tag assemblies 100 may be sent back to a manufacturer or at a distribution center and applied to other or different garments. The memories of the hard tag assemblies 100 may then be reprogrammed based on the garments to which they are applied. It is noted that the programing or reprogramming may be done at other locations, such as retail stores, shipping centers, or the like. As hard tag assemblies 100 are shipped for reuse, the physical dimensions and weights of the hard tag assemblies 100 may affect shipping costs. Embodiments described herein provide for reduced physical dimensions and weights while maintaining or improving performance, which may result in reduced shipping costs and other efficiencies as may be apparent in accordance with this disclosure.

Figure 6:
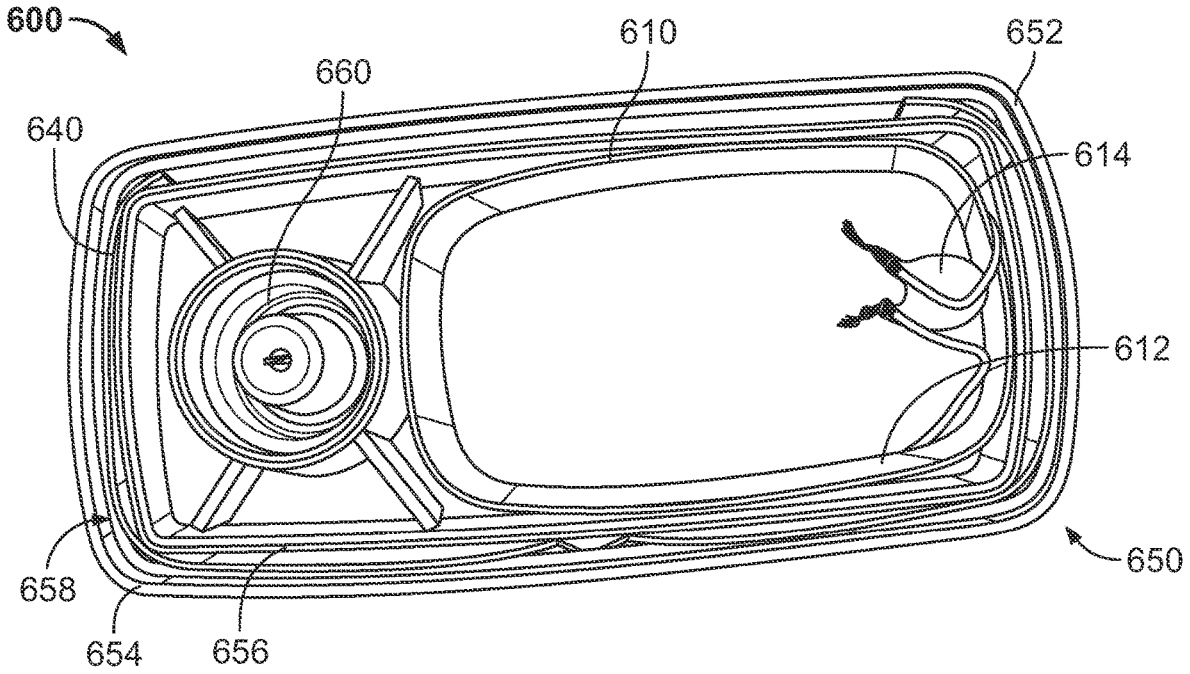
FIG. 6 is a top, cross-sectional view of a hard tag comprising an EAS component that does not circumscribe a locking mechanism in accordance with various disclosed aspects.

Turning now to FIG. 6 there is a dual hard tag assembly 600. It is noted that like named components of the hard tag assembly 600 and various other disclosed hard tags may comprise similar aspects or functionality. For instance, hard tag assembly 600 may comprise an EAS component 610, an RFID label 640, a housing 650 (though hard tag assembly 600 is illustrated with the bottom cover removed for simplicity of explanation), and a locking mechanism 660. These components may comprise similar aspects as component 610, an RFID label 640, a housing 650, and a locking mechanism 660, unless explicitly stated or context suggests otherwise. Moreover, embodiments may utilize different combinations or modifications of hard tag assemblies 100 and 600.

Hard tag 600 illustrates top cover 652 comprising formations 656. The formations 656 form a channel 658 or inner wall with perimeter 654 of the top cover 652. The channel 658 may be sized and shaped to receive the RFID label 640 and may retain the RFID label 640 when the bottom cover (not shown) is attached to the top cover 652. It is noted that RFID label 640 may be adhered within the channel 658, may be clipped or fastened within the channel, may be held in place by a padding or gasket, or the like. Moreover, some other embodiments may include a bottom cover with a channel formed therein, in addition to or as an alternative to a channel formed with the top cover 652.

EAS component 610 may include an antenna 612 and an integrated circuit or EAS chip 614. The EAS chip 614 may be coupled to the antenna 612. In an aspect, the antenna 612 is disposed in a portion of the housing 650 so as not to circumvent the locking mechanism 660. The locking mechanism 600 may comprise metallic components that may interfere with magnetic files of the antenna 612. Having the antenna 612 disposed adjacent to but not circumventing the locking mechanism 600 may reduce interference from the locking mechanism 600. This may provide for improved efficiency, strength, reduced size, or the like.

Figure 7:
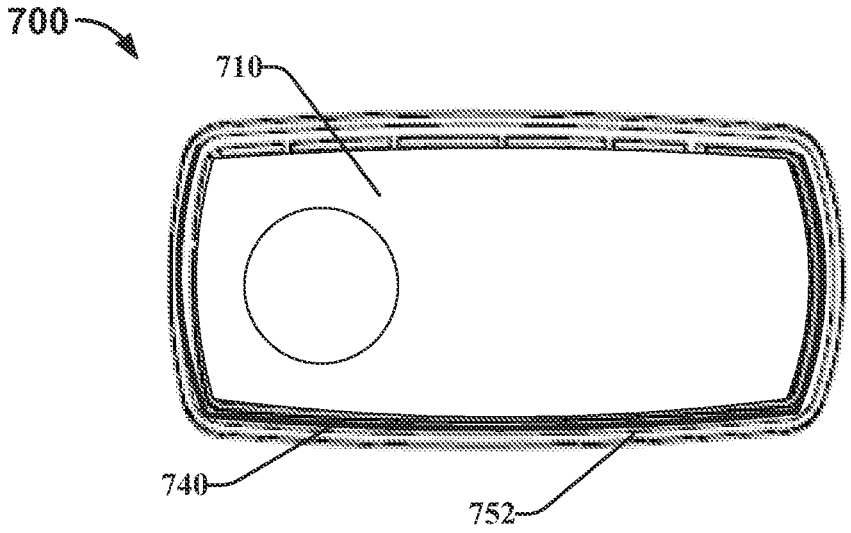
FIG. 7 is a top, cross-sectional view of a hard tag comprising an EAS inlay generally orthogonal with an RFID inlay in accordance with various disclosed aspects.

FIG. 7 illustrates dual hard tag assembly 700 comprising an EAS inlay or label 710 disposed generally parallel with a bottom plane of a top cover 752 of a housing. It is noted that the EAS inlay 710 may be adhered to the bottom surface of the top cover 752, retained by fasteners, retained by formations of the top cover 752 or a bottom cover (not shown for visibility), or otherwise disposed within the hosing. Hard tag assembly 700 may include RFID label 740 disposed generally orthogonal to the EAS inlay 710.

Figure 8:
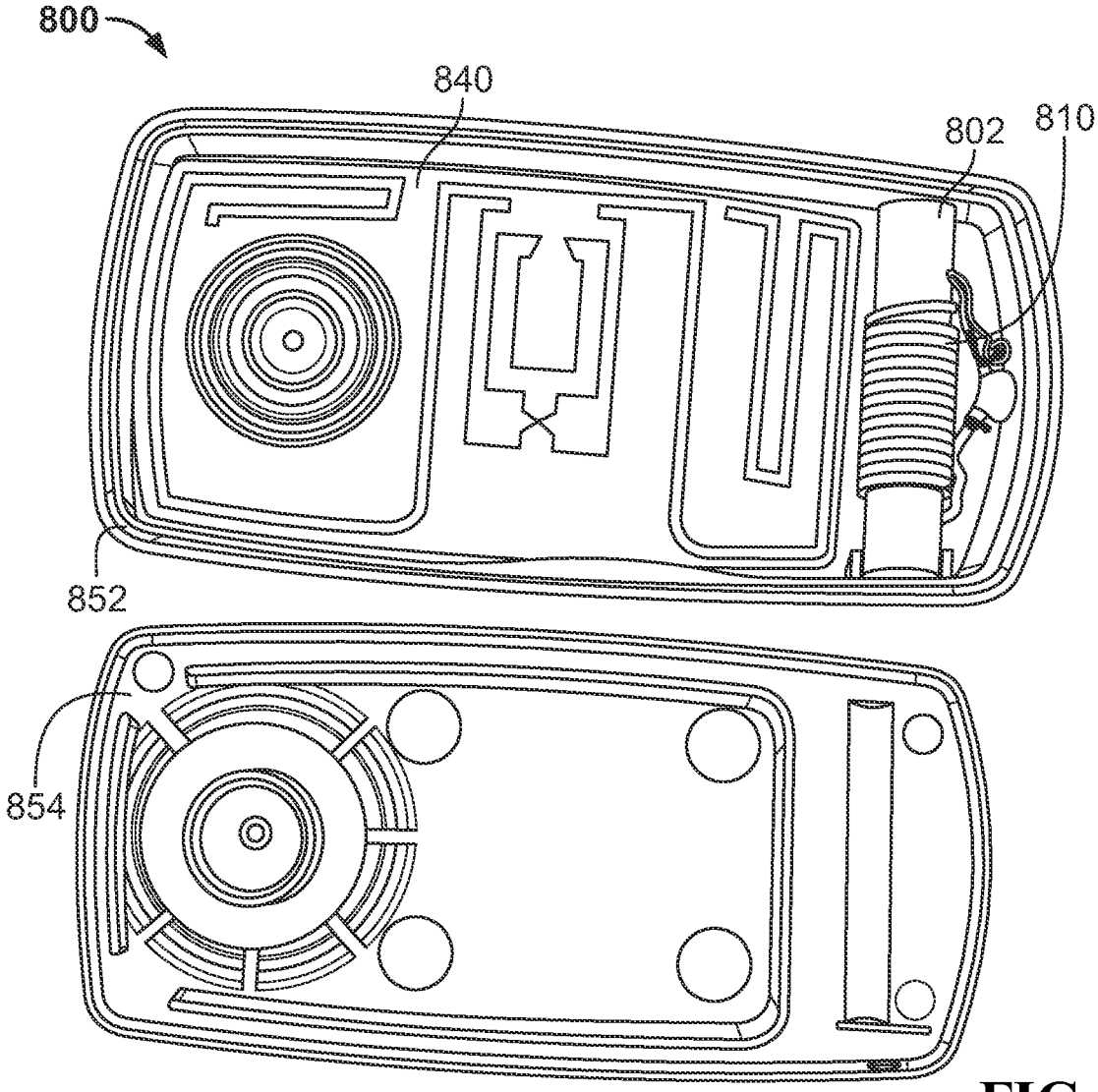
FIG. 8 is a top, cross-sectional view of a hard tag comprising an RFID inlay generally adjacent and not overlapping with an EAS component in accordance with various disclosed aspects.
Figure 9:
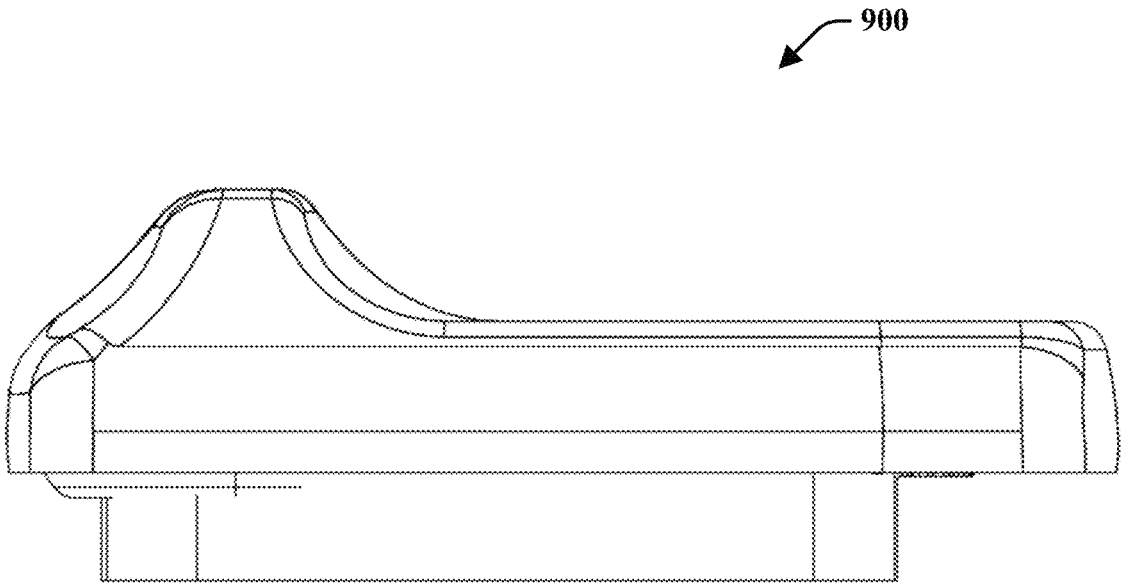
FIG. 9 is a side view of a hard tag in accordance with various disclosed aspects.
Figure 10:
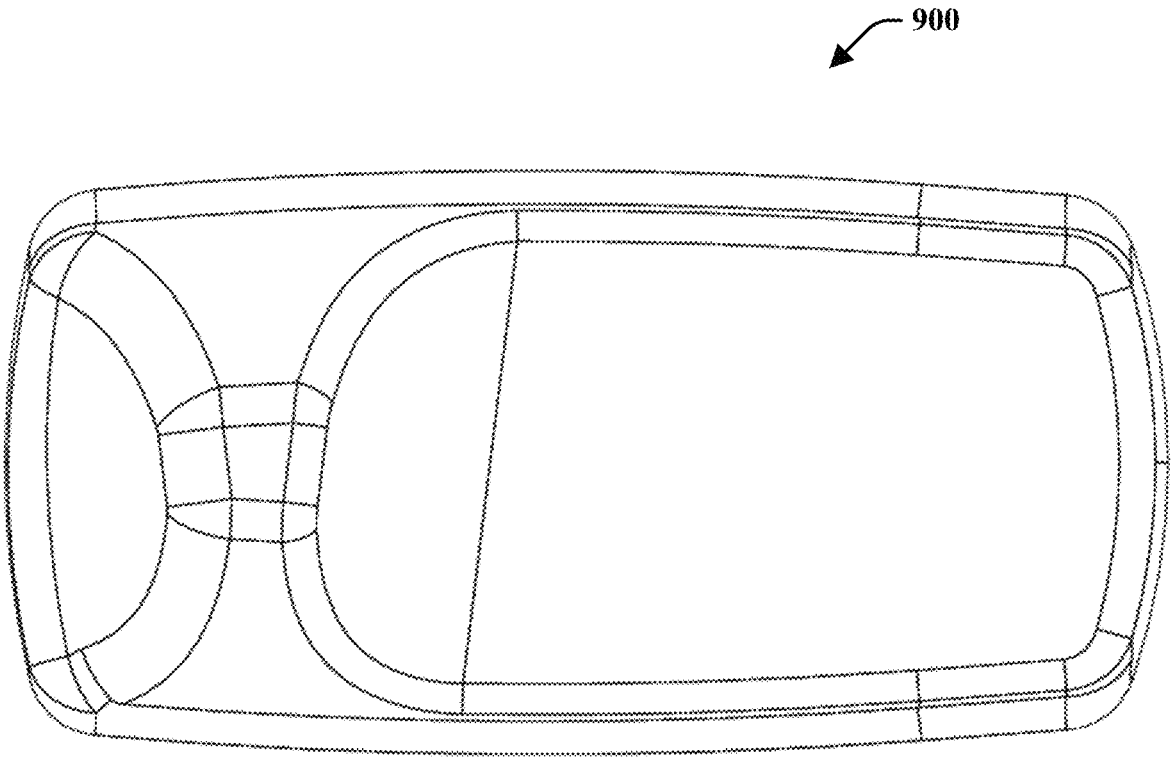
FIG. 10 is a top view of the hard tag of FIG. 9 in accordance with various disclosed aspects.
Figure 11:
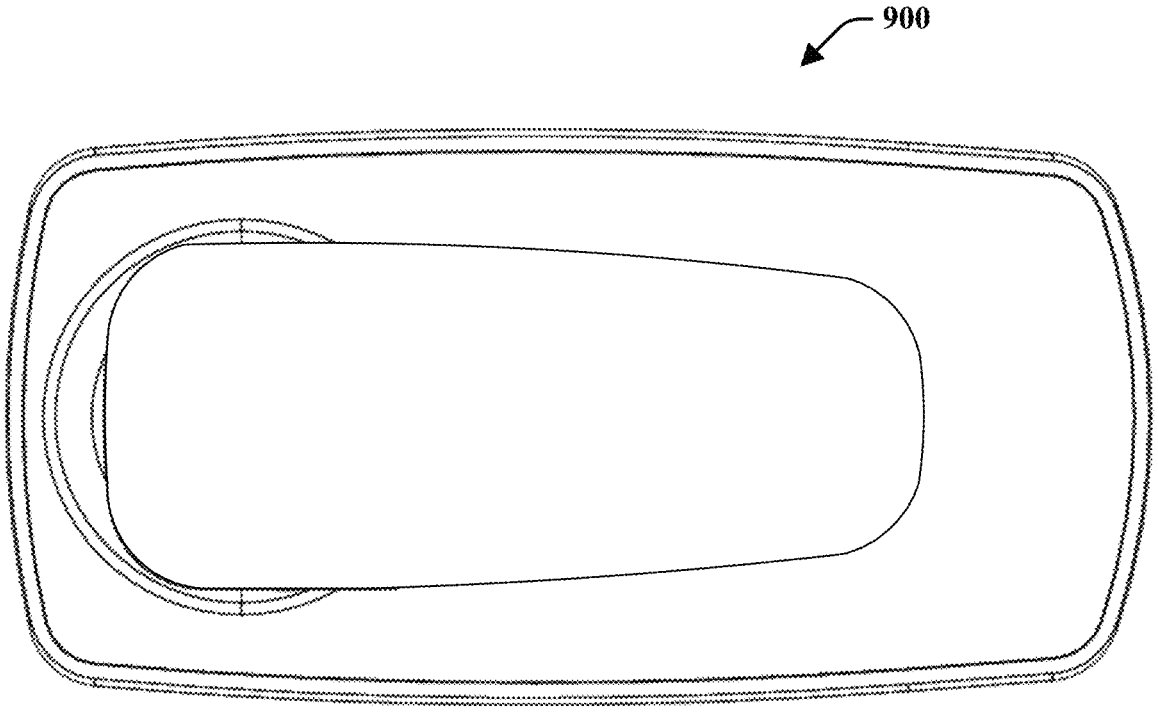
FIG. 11 is a bottom view of the hard tag of FIG. 9 in accordance with various disclosed aspects.
Figure 12:
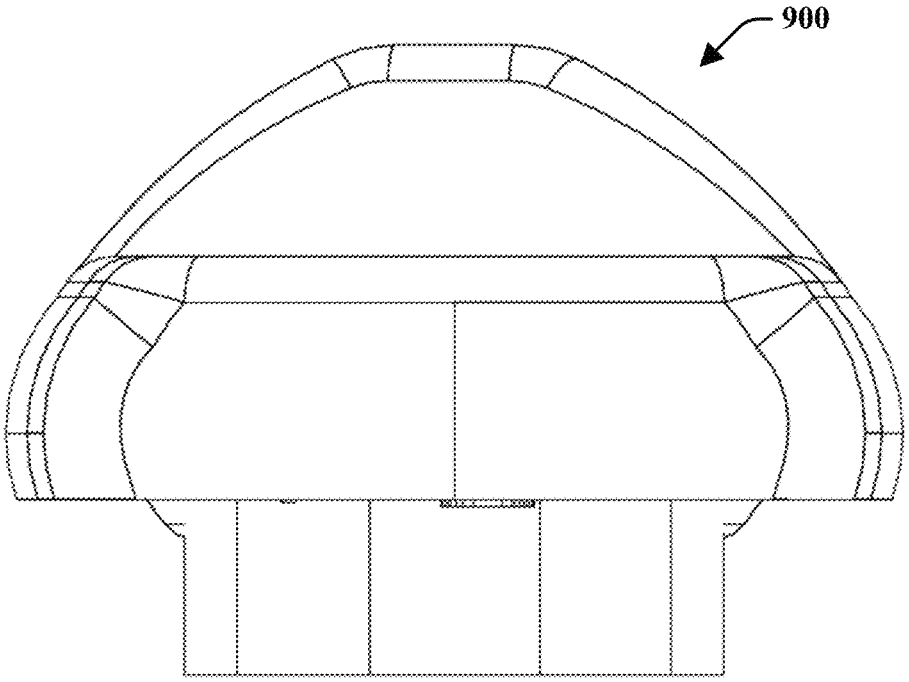
FIG. 12 is a back view of the hard tag of FIG. 9 in accordance with various disclosed aspects.
Figure 13:
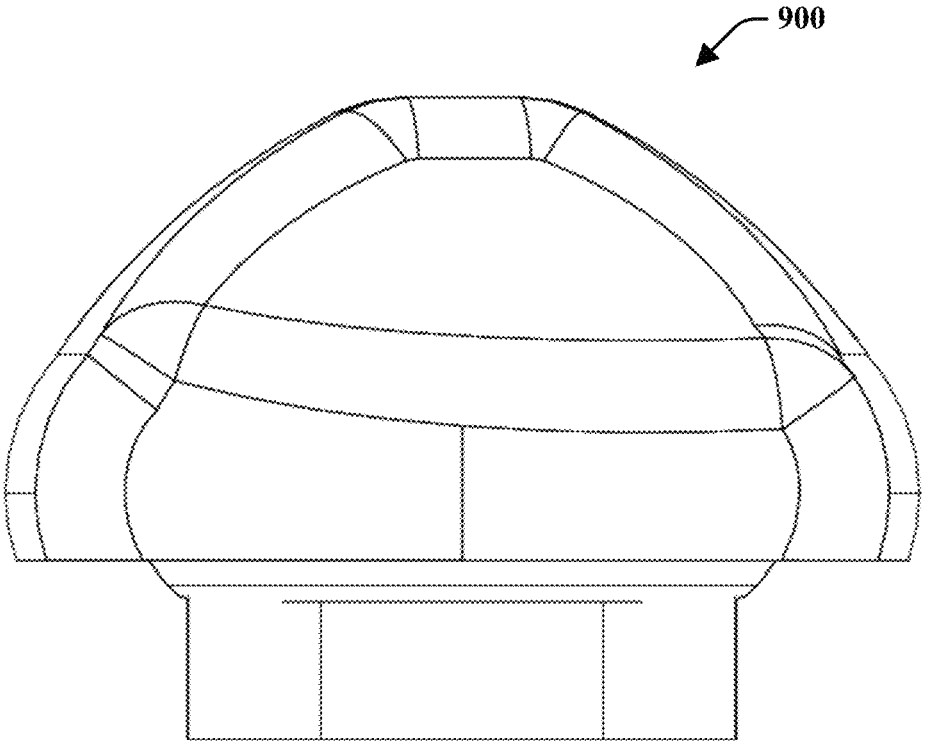
FIG. 13 is a front view of the hard tag of FIG. 9 in accordance with various disclosed aspects.
Figure 14:
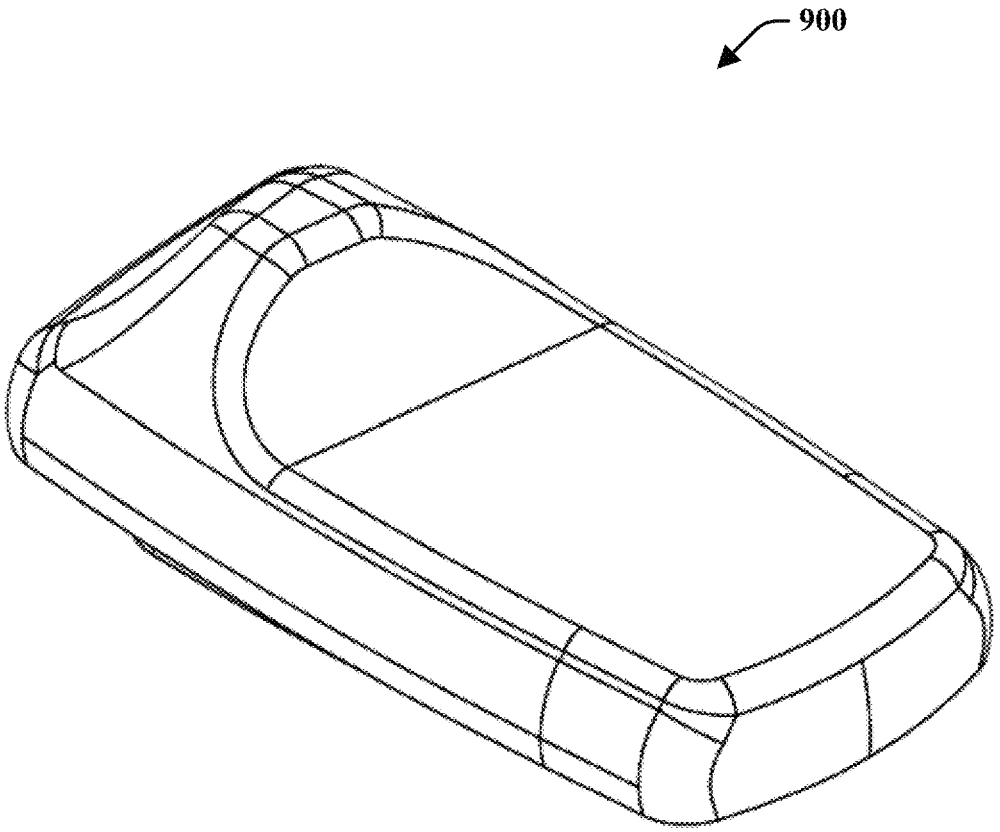
FIG. 14 is a perspective view of the hard tag of FIG. 9 in accordance with various disclosed aspects.
Figure 15:
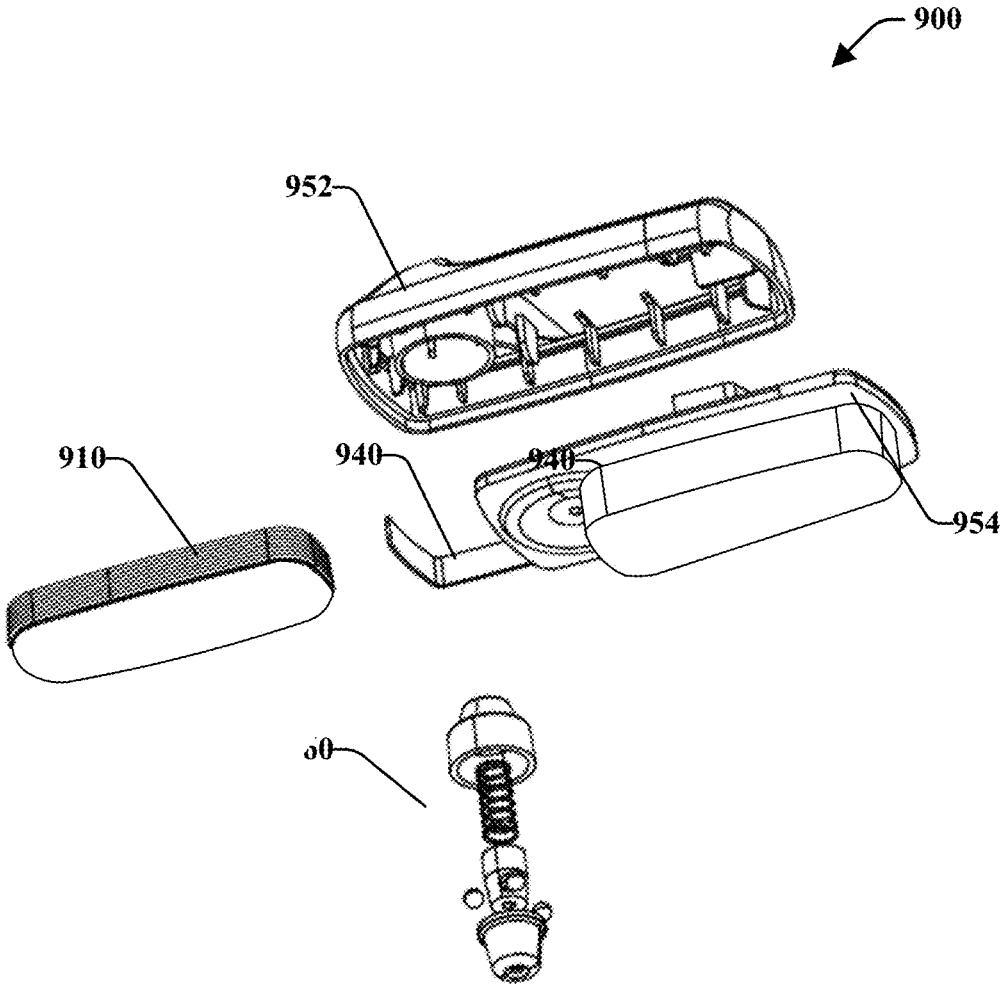
FIG. 15 is a bottom, exploded side view of the hard tag of FIG. 9 in accordance with various disclosed aspects.
Figure 16:
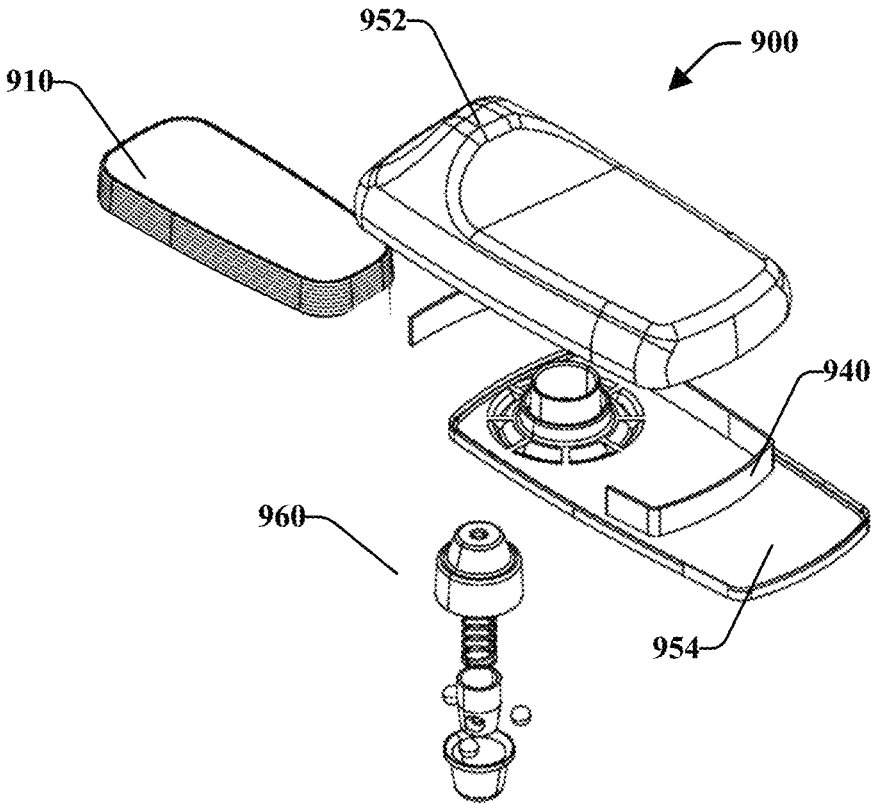
FIG. 16 is a top, exploded side view of the hard tag of FIG. 9 in accordance with various disclosed aspects.
Figure 17:
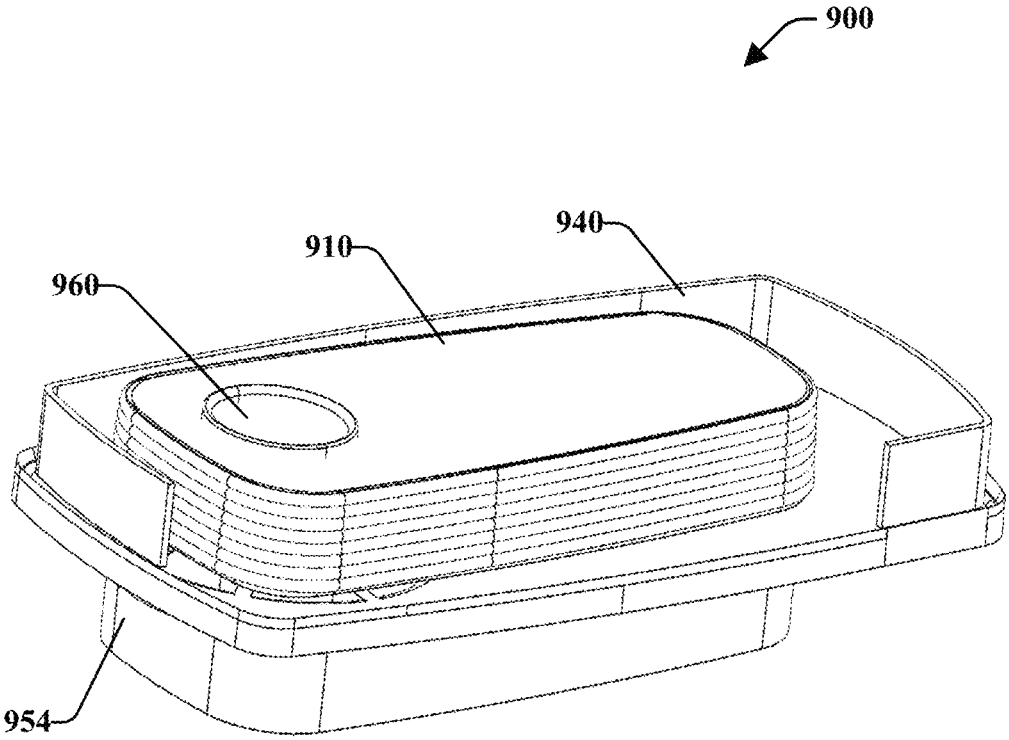
FIG. 17 is a perspective view of the hard tag of FIG. 9 with a top cover removed in accordance with various disclosed aspects.

FIG. 8 illustrates dual hard tag assembly 800 comprising an EAS component 810 disposed generally adjacent to an RFID label 840 that may be generally parallel with a bottom plane of a top cover 852 of a housing. It is noted that the RFID label 840 may be adhered to the bottom surface of the top cover 852, retained by fasteners, retained by formations of the top cover 852 or a bottom cover 854 (shown detached from top cover 852 for visibility), or otherwise disposed within the housing. EAS component 810 may comprise a loop antenna 812 disposed about a tube 802. It is noted that the EAS component 810 and the RFID label 840 do not overlap vertically. This may reduce interference between or among the RFID label 840 and the EAS component 810. It is noted that hard tag assemblies 700 and 800 may include similar aspects as those described with reference to the other figures.

FIGS. 9-17 illustrate various views of a dual hard tag assembly 900 primarily comprising a housing 950, a locking element 960, an EAS component 910, and an RFID label 940. It is noted that like named components of the hard tag assembly 900 and various other disclosed hard tags may comprise similar aspects or functionality. For instance, the EAS component 910 may comprise an antenna that is non-overlapping, non-coplanar, or both non-overlapping and non-coplanar with the RFID label 940. The housing 950 may comprise a top cover 952 and a bottom cover 954.

What has been described above includes examples of the present specification. It is, of course, not possible to describe every conceivable combination of components or methodologies for purposes of describing the present specification, but one of ordinary skill in the art may recognize that many further combinations and permutations of the present specification are possible. Each of the components described above may be combined or added together in any permutation to define embodiments disclosed herein. Accordingly, the present specification is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A security tag comprising:

a housing;

an inventory tracking circuit disposed within the housing, the inventory tracking circuit comprising an antenna and a memory configured to store inventory parameters; and a security circuit comprising a wireless device that operatively monitors for a wireless signal in a given frequency, and responds to the wireless signal when detected to initiate an alert associated with improper removal of the item, wherein the security circuit is disposed radially inward to the inventory tracking circuit and the inventory tracking circuit does not vertically overlap with the security circuit.

2. The security tag of claim 1, wherein the housing comprises a hard plastic material.

3. The security tag of claim 1, wherein the inventory tracking circuit comprises a radio frequency identification label.

4. The security tag of claim 1, wherein the security circuit comprises an electronic article surveillance device.

5. The security tag of claim 1, wherein the inventory tracking circuit is generally orthogonal with the security tracking circuit.

6. The security tag of claim 1, wherein the inventory tracking circuit is non-coplanar with the security tracking circuit.

7. The security tag of claim 1, wherein the inventory tracking circuit is non-overlapping with the security tracking circuit with respect to a plane defined by a bottom surface of the housing.

8. The security tag of claim 1, wherein the security tracking circuit comprises an electronic article surveillance inlay.

9. The security tag of claim 1, wherein the security tracking circuit comprises a loop antenna.

10. A security tag comprising;

a housing comprising an internal cavity;

a radio frequency identification label disposed within the internal cavity;

an electronic article surveillance circuit disposed within the internal cavity; and a locking mechanism, wherein the electronic article surveillance device is disposed radially inward to the radio frequency identification label, and the radio frequency identification label is non-overlapping vertically with the electronic article surveillance circuit.

11. The security tag of claim 10, wherein the electronic article surveillance circuit comprises a loop antenna.

12. The security tag of claim 11, wherein the loop antenna encompasses the locking mechanism.

13. The security tag of claim 11, wherein the loop antenna is free from encompassing the locking mechanism.

14. The security tag of claim 10, wherein the housing comprises a bottom internal surface and wherein the radio frequency identification label is disposed on the bottom internal surface.

15. The security tag of claim 10, wherein the housing comprises an internal formation that retains the radio frequency identification label.

16. The security tag of claim 15, wherein the internal formation comprises a channel.

17. A security tag comprising:

a housing comprising an internal perimeter, an inventory tracking circuit disposed within the housing, the inventory tracking circuit comprising an antenna and a memory configured to store inventory parameters; and a security circuit comprising a wireless device that operatively monitors for a wireless signal in a given frequency, and responds to the wireless signal when detected to initiate an alert associated with improper removal of the item, wherein the inventory tracking circuit comprises a label that abuts at least a portion of the internal perimeter, and wherein the security circuit is disposed radially inward to the inventory tracking circuit and the inventory tracking circuit does not vertically overlap with the security circuit.

18. The security tag of claim 17, wherein the label operatively abuts a majority of the internal perimeter.

19. The security tag of claim 17, wherein the label operatively abuts generally the entire internal perimeter.

20. The security tag of claim 17, wherein the label is non-coplanar and non-overlapping with the security circuit.

* * * * *